United States Patent [19]

Hoggan et al.

[11] Patent Number: 4,799,671

[45] Date of Patent: Jan. 24, 1989

[54] WEIGHT LIFTING EXERCISE APPARATUS

[75] Inventors: Lynn D. Hoggan, Sandy; Earl Van Wagoner, III, West Jordan; Edward N. Balogh, Salt Lake City, all of Utah

[73] Assignee: Hoggan Health Industries, Inc., Draper, Utah

[21] Appl. No.: 916,641

[22] Filed: Oct. 8, 1986

[51] Int. Cl.[4] ..... A63B 21/06

[52] U.S. Cl. ..... 272/118; 272/134

[58] Field of Search ..... 272/118, 134, 138, 93, 272/116, 117, 143

[56] References Cited

U.S. PATENT DOCUMENTS 3,708,166 2/1973 Annas ..... 272/118 X
4,199,139 4/1980 Mahnke et al. ..... 272/118
4,563,003 1/1986 Bugallo et al. ..... 272/118
4,635,926 1/1987 Minkow ..... 272/118

*Primary Examiner*—David H. Corbin
*Attorney, Agent, or Firm*—Mallinckrodt & Mallinckrodt

[57] ABSTRACT

Exercising apparatus is constructed with operating mechanism that includes a stationary platform elevated above user-accommodating level sufficiently to support a stack of weights in a position corresponding approximately with the position of the user's head, so weight selection is facilitated and so such mechanism can be attractively housed. A weight carrier includes weight connection members rising from an elevator platform that is adapted to be raised by muscle power of the user along with a user-selected number of weights connected thereto.

20 Claims, 6 Drawing Sheets

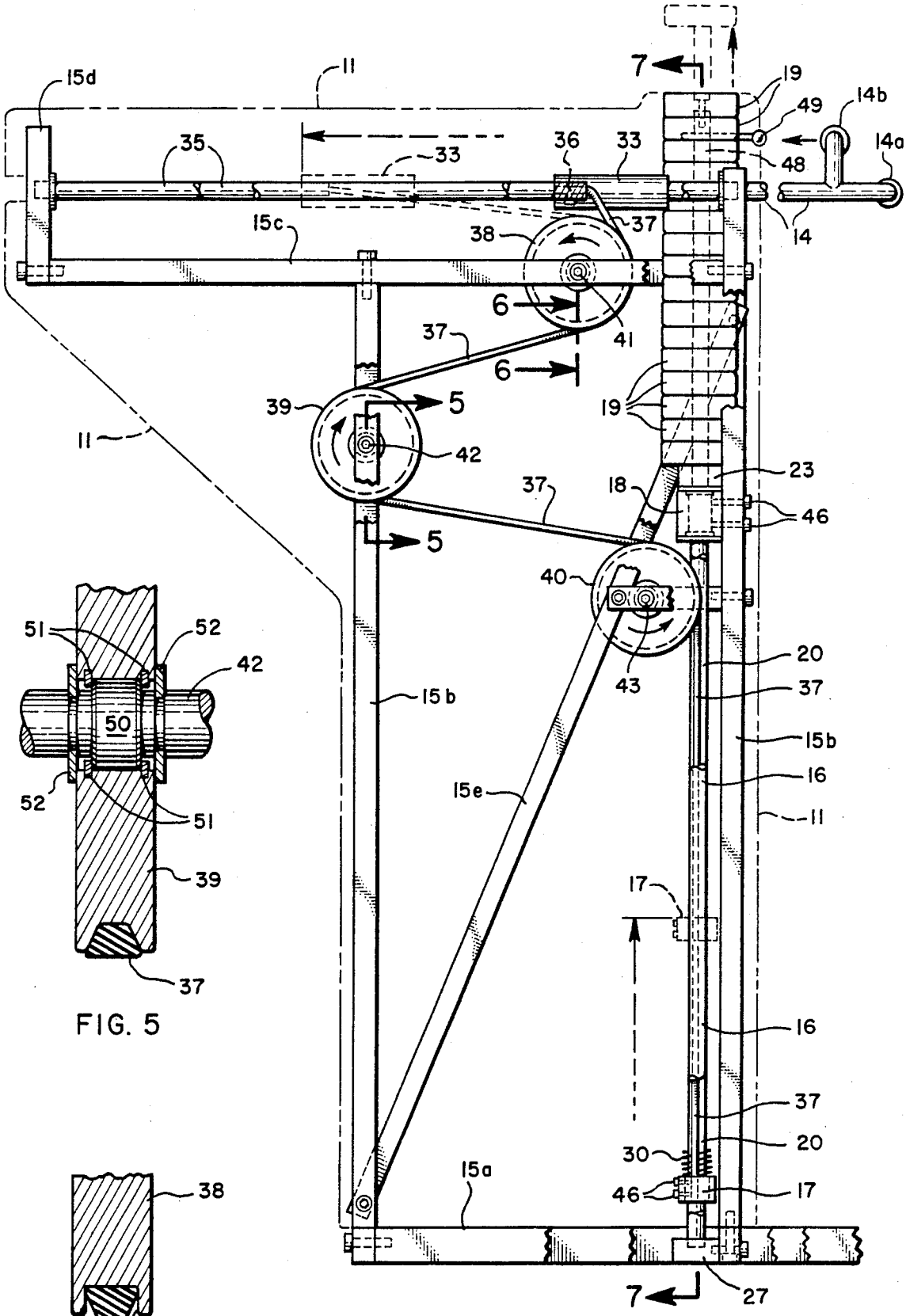
FIG. 3
FIG. 5
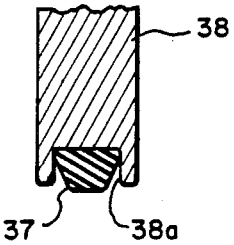
FIG. 6

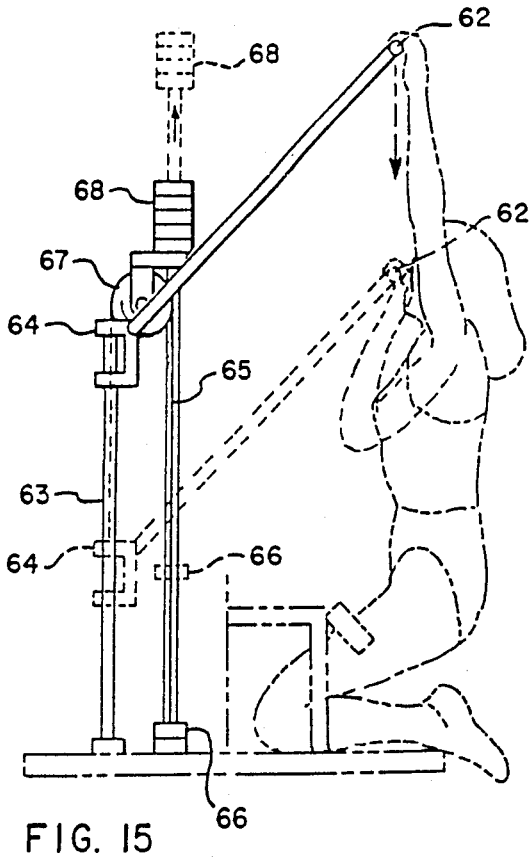
FIG. 15
FIG. 16
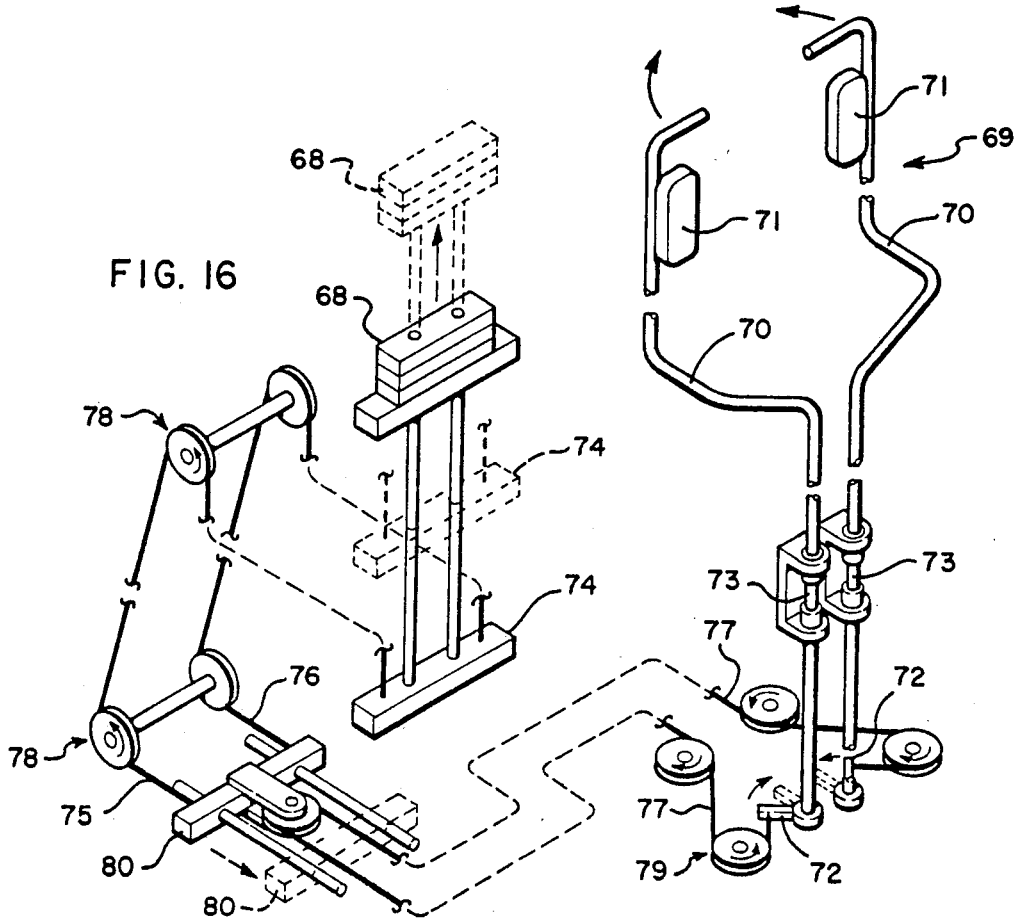

WEIGHT LIFTING EXERCISE APPARATUS

BACKGROUND OF THE INVENTION

1. Field:

This invention has to do with apparatus for exercising the human body by the lifting of weights.

2. State of the Art:

Weight lifting has long been utilized as a way of exercising the human body to keep it in good health and to build up muscle power. A common way to do this is by the use of apparatus providing weights slideably mounted in a frame for repeated raising and lowering by a person standing, seated, or reclining on a part of the apparatus poviding for same. Usually it is the arms which are used to raise and lower the weights, but apparatus is also designed for use of the legs for this purpose. However, so far as is known, apparatus of the type concerned has always had the weights positioned for lifting from at or from adjacent to the bottom of the apparatus, which is not readily accessible to the one using the apparatus and which limits design to a cumbersome appearance.

SUMMARY OF THE INVENTION

A principal objective in the making of the invention was to provide for placement of the weights at approximately eye level for all sitting and standing use of the apparatus, thereby giving the user a feeling of close association with operation of the apparatus and the benefits to be derived therefrom and allowing for an integrated and pleasing ornamental appearance for the apparatus as a whole.

In accordance with the invention, the weights are stacked on a stationary platform rigidly supported at an elevated level relative to the bottom of the apparatus and are selectively interlockable with a carrier structure that is associated therewith for upward movement in accordance with force applied by the user to mechanism provided for manipulation by him or her. Such mechanism is advantageously linked to one set of ends of pull lengths of flexible material, which pass over respective pulleys and are attached at their opposite set of ends to mutually opposite portions of an elevator platform forming a lower part of the carrier structure. The stacked weights are positioned at approximately eye level of the user and the entire mechanism can be attractively housed.

THE DRAWINGS

Several embodiments of weight lifting apparatus presently contemplated as the best modes of carrying out the invention in actual practice are shown in the accompanying drawings in which:

FIG. 1 is a pictorial view looking almost squarely toward one side of one form of weight lifting apparatus wherein the user is in a partly standing and partly sitting position as he or she pushes on handles to lift several of the total number of weights by the muscles of his or her arms;

FIG. 2, another pictorial view of the same apparatus looking from the rear and the opposite side toward the user's position, which is now unoccupied to provide a representation of what the user sees as he or she operates the weight-lifting mechanism, the total stack of weights being shown in the at-rest position;

FIG. 3, a view in side elevation, drawn to a larger scale, of the mechanism and supporting framework of the apparatus as shown in FIG. 2, with housing removed but its position being indicated by broken lines;

FIG. 4, a pictorial view of the mechanism and supporting structure of FIG. 3 drawn to the same scale, but with minor portions being broken away for convenience of illustration, a greater number of the weights than in FIG. 1 being shown as lifted a greater distance than in FIG. 1;

FIG. 5, a fragmentary vertical section taken along the line 5—5 of FIG. 3 and drawn to an even larger scale;

FIG. 6, a similar view taken along the line 6—6 of FIG. 3;

FIG. 7, a view taken along the line 7—7 of FIG. 3 but drawn to a larger scale, with intermediate parts broken out for convenience of "illustration";

FIG. 8, a fragmentary horizontal section taken along the line 8—8 of FIG. 4 and drawn to a larger scale;

FIG. 9, a fragmentary vertical section taken along the line 9—9 of FIG. 7 and drawn to a larger scale;

FIG. 10, a bottom plan view taken along the line 10—10 in FIG. 9; and

FIGS. 11–16, schematic views of alternative mechanisms for other embodiments designed for special muscle exercising.

DETAILED DESCRIPTION OF ILLUSTRATED EMBODIMENTS

Figure 1:
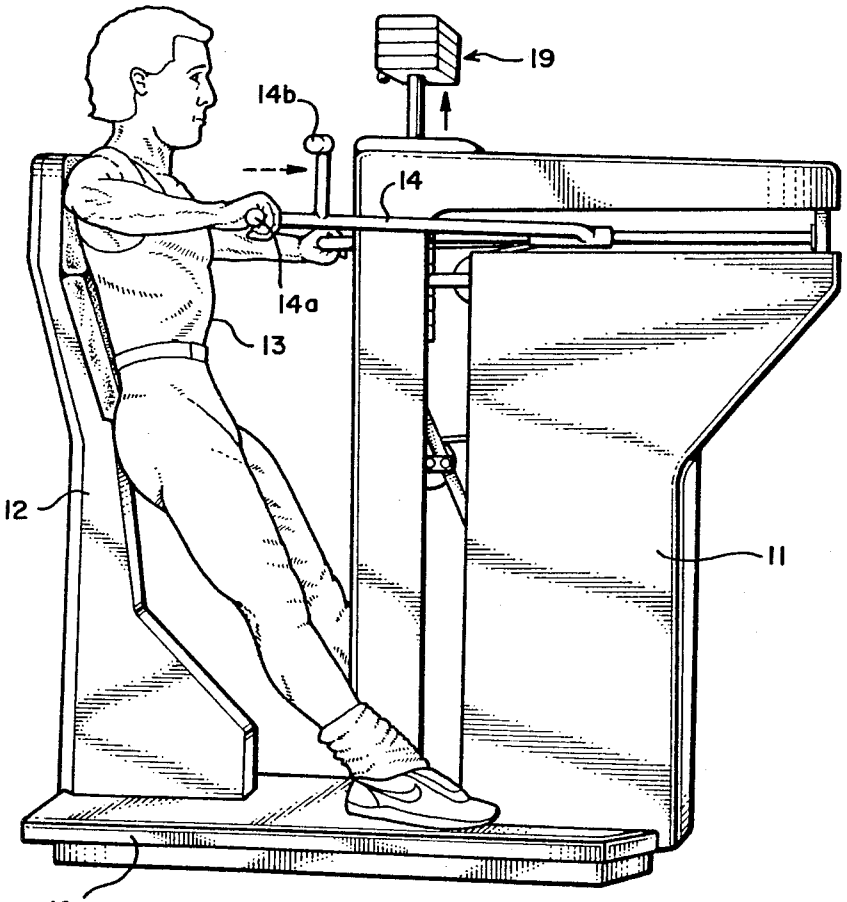

As illustrated, the embodiment of FIGS. 1–10 comprises a base 10, a housing 11 enclosing weight-lifting mechanism, and a support 12 for the person 13 using the apparatus. The person using the apparatus as here shown is in a half standing and a half seated position leaning backward against support 12 as his arms push operating members 14, at opposite sides, respectively, of the apparatus, away from his chest in the direction of the appended arrow. His hands engage either handles **14*a*, respectively, as shown in FIG. 1, or handles 14*b***, respectively.

Details of the weight lifting mechanism may vary from one embodiment to another. In the present embodiment of FIGS. 1–10, a structural framework 15, see particularly FIG. 4, has a horizontal base frame **15*a* on which is erected a vertical box frame 15*b*, surmounted by a horizontal upper frame 15*c* having four upstanding corner posts 15*d*, respectively. Diagonal braces 15*e* in box frame 15*b* and a horizontal brace 15*f* between the forward pair of corner posts 15*d* complete the framework 15**.

Upstanding from horizontal base frame **15*a* intermediate its length at, but offset forwardly from, the rear side of box frame 15*b* are two spaced apart, vertical, guide columns 16, respectively, for guiding up and down sliding movement of weight carrier means, which, in this instance, comprises a transversely extending, elongate, elevator platform 17 through which the guide columns 16 extend. The upper ends of guide columns 16 are affixed to opposite end portions, respectively, of a stationary, elongate, transversely extending platform 18 on which a number of weights 19 are stacked for selective attachment to the upper end portions of spaced apart, vertical, carrier slide rods 20, respectively, that rise fixedly from elevator platform 17 and pass slideably through, first, respective linear bearings 21, FIG. 7, in opposite end portions of stationary platform 18, then through corresponding holes 22, respectively, in an elastomer bumper 23, and finally through corresponding holes 19*a*, respectively, in each of the weights 19 except the topmost one, which fits over the upper ends of such slide rods and is secured thereto by cap screws 24**, respectively.

Figure 4:
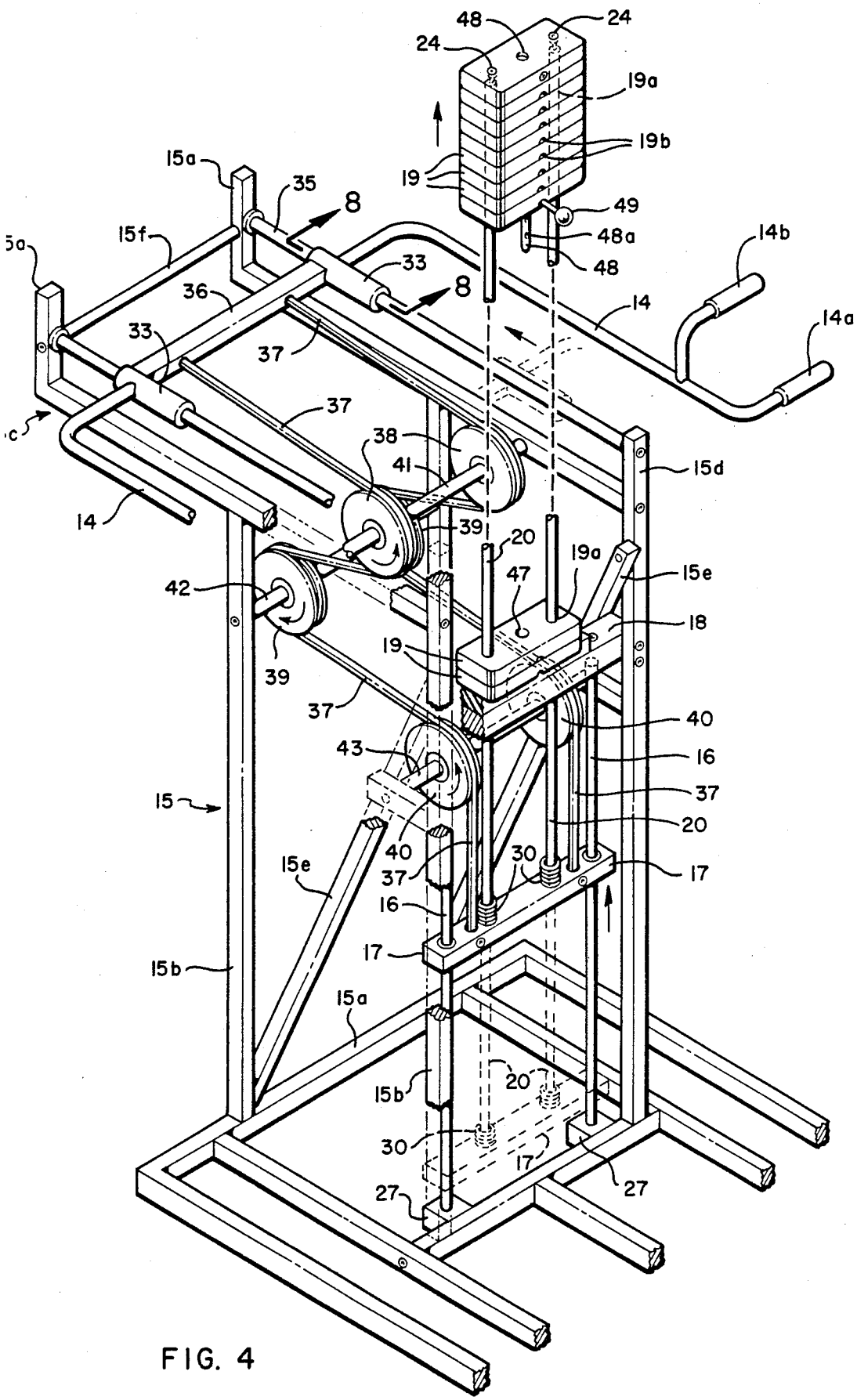
Figure 7:
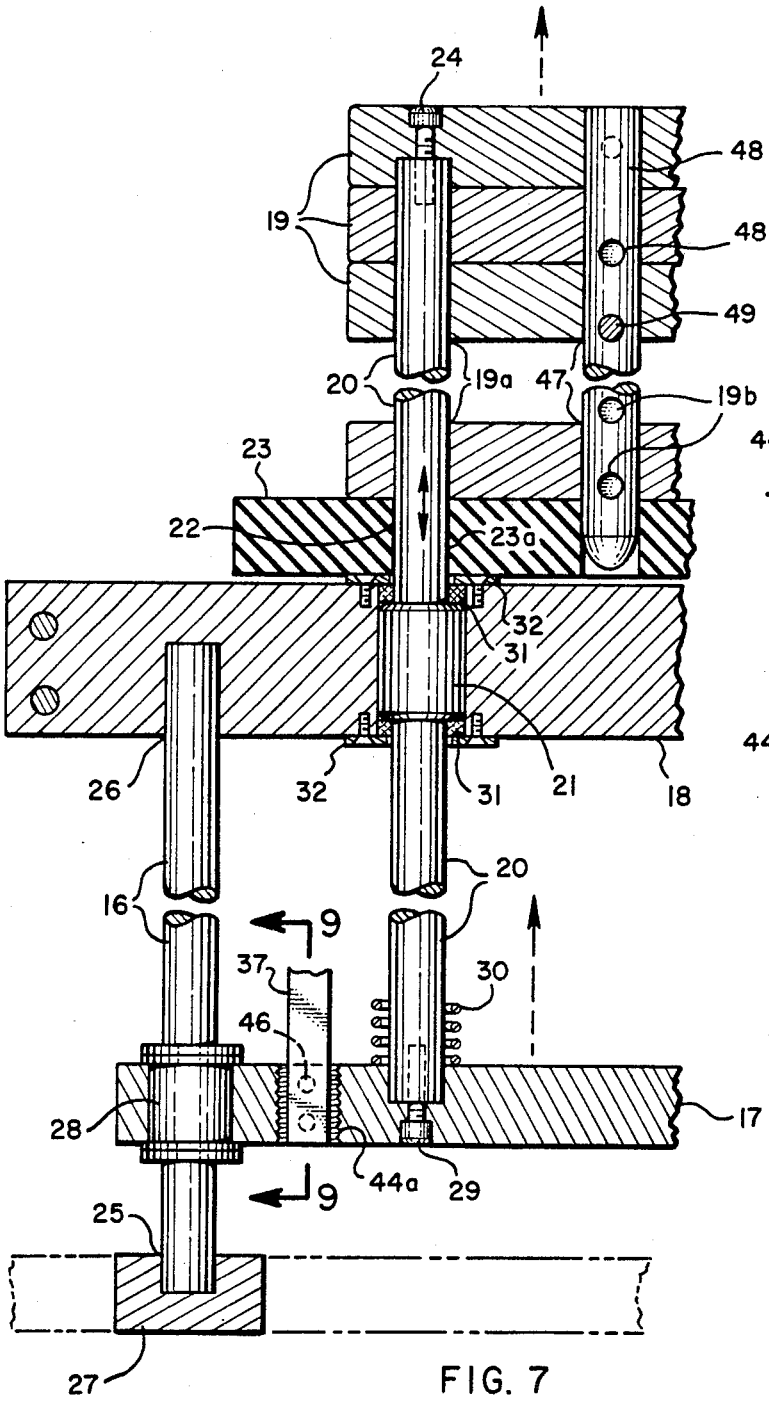

The ends of guide columns 16 are conveniently inserted in sets of bores 25 and 26, respectively, FIG. 7, provided in blocks 27, FIG. 4, forming part of base frame 15a, and in stationary platform 18, respectively. The columns extend upwardly through linear bearings 28 in elevator platform 17.

Carrier slide rods 20 have their lower ends recessed in elevator platform 17 and anchored by respective cap screws 29, FIG. 7. They are encircled by respective coil springs 30, which provide bumpers relative to the lower face of stationary platform 18 to cushion abutment of elevator platform 17 thereagainst at the terminations of the weight-lifting strokes. The linear bearings 21 through which they slide are prelubricated and provided, above and below, with sealing rings 31 held in place by retainer rings 32.

Figure 8:
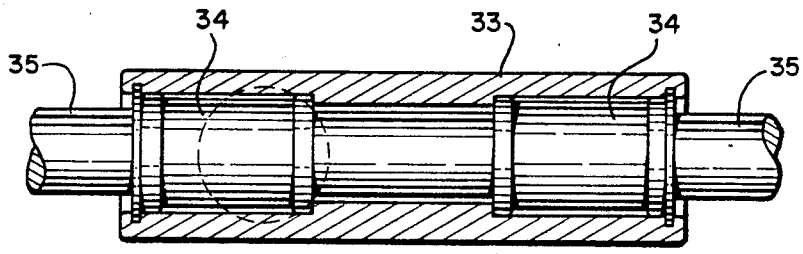

Operating members 14 are fixedly secured to sleeves 33, respectively, FIG. 4, that are slideably mounted, as by means of respective sets of linear bearings 34, FIG. 8, on rods 35, respectively, which extend between and are secured at their opposite ends to sets of front and rear frame corner posts 15*d* and 15*a*, respectively. A cross-bar 36 rigidly interconnects sleeves 33, and secured thereto in spaced apart relationship is one set of ends of a pair of pull lengths of flexible material, here shown as V-belts 37. Such V-belts are trained over a system of pulleys and have their opposite set of ends secured to opposite end portions of elevator platform 17. In this instance, the pulley system comprises mutually opposite sets of three pulleys each, i.e. the pulleys 38, 39, and 40, corresponding pulleys of the two sets being mounted on jack shafts 41, 42, and 43, respectively.

Figure 9:
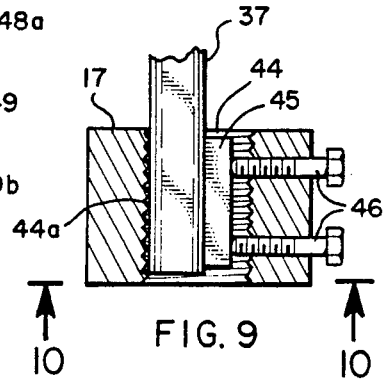
Figure 10:
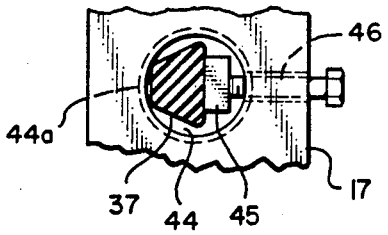

Corresponding ends of V-belts 37 are advantageously secured to elevator platform 17 by special connections, as shown in FIGS. 9 and 10. The V-belt ends are inserted in respective cylindrical bores 44 in opposite end portions of platform 17 and are held in place by cinch plates 45 pressed tightly against them by means of screw bolts 46. Bores 44 are internally threaded or otherwise knurled, as at 44*a*, to catch and hold the V-belt ends when pressed thereagainst.

The same securement system is advantageously applied to secure the opposite set of V-belt ends to cross-bar 36.

The stack of weights 19 rests on bumper 23 atop of stationary platform 18, with carrier rods 20 extending slideably through respective receiving holes 23a and 19a therein, such rods terminating in closed, upper end bores, that are provided in the uppermost weight instead of, but as continuations of, the holes 19*a* in the lower weights, and being secured to the uppermost weight by the cap screws 24, respectively. Extending through registered receiving holes 47, FIG. 7, centrally of the stack of weights is a latch rod 48 provided with a vertical series of horizontal latch-bolt-receiving openings 48*a* adapted to register and interconnect, respectively, with corresponding latch-bolt-receiving passages 19*b* that extend from the rearward faces of the individual weights. With a stack of the weights 19 resting on bumper pad 23 and supported by stationary platform 18, the user of the apparatus can select the number of weights to be lifted at any given time by inserting a latch bolt 49 into the receiving passage 19*b* of the lowest weight of that number of such weights, counting from the top of the stack, which he has selected as the total weight to be lifted, and by pushing such latch bolt into engagement with the registering opening 48*a* of latch rod 48.

Figure 2:
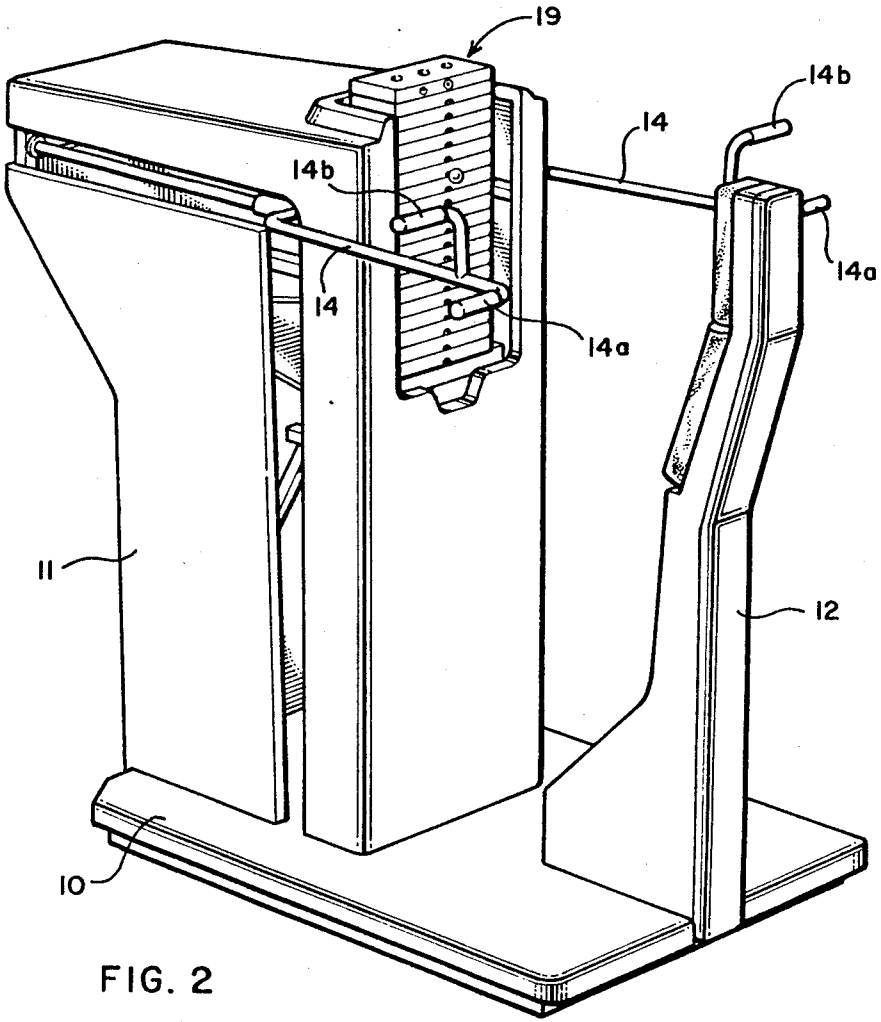

It can be seen that, positioned as the weight stack is, at an elevated level approximately in line with the position of the user's head, the number of weights can be easily selected visually and can be easily latched in place for lifting, and that the number of weights to be lifted can be easily changed from time-to-time by the user without changing the position of his body within the apparatus. Moreover, as shown by FIGS. 1 and 2, the stack of weights 19 and the operating mechanism of the apparatus may be attractively housed by a casing, such as 11, and provided with a body support, such as 12, of various ornamental configurations, several of which form the subject matters of copending design patent application Ser. Nos. 919,863; 919,864; and 919,865, filed by John Griffin on Oct. 16, 1986. In this connection, it should be noted that there is no part of the operating mechanism that extends above the stack of weights. All structure is located below or laterally thereof.

Although the pulleys 38, 39, and 40 may be mounted on their respective jack shafts in any suitable manner, it is preferred to mount each of them, as shown in FIG. 5, in an antifriction bearing 50 held in place by internal snap rings 51, respectively, the pulley itself being held in place by external snap rings 52. It should be noted that pulleys 38 and 40 are flat-grooved as shown for pulley 38 in FIG. 6 at 38a since the flat faces of the respective V-belts 37 are received by these pulleys. Pulleys 39 are V-grooved, as shown in FIG. 5.

Figure 11:
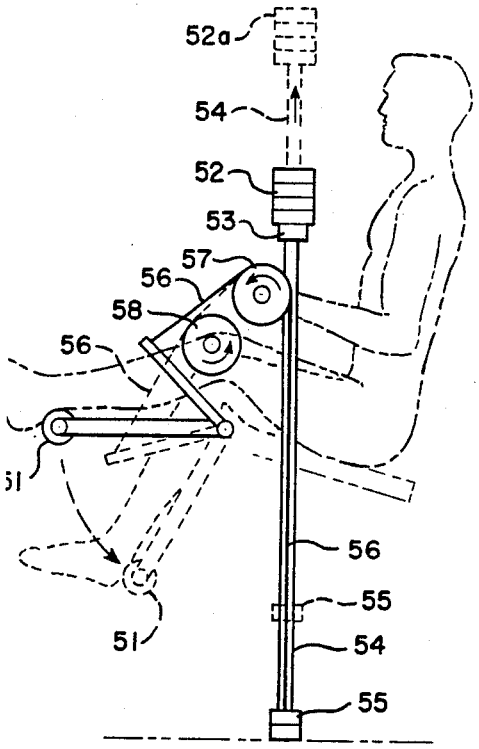

The schematic showing in FIG. 11 is of an embodiment of the invention in which the user's legs, either one or both, curl over and around a pivotally-mounted roller 51 so as to move it downwardly, as shown by the appended arrow, while lifting selected number of weights 52a from a stack of such weights from rest on stationary platform 53. The selected number of the weights are attached to carrier slide rods 54, as in the previous embodiment, and are lifted with elevator platform 55 when belts 56, operating over respective sets of pulley 57 and 58 (both of flat formation) are pulled by the lowering of roller 51 through leg muscles of the user.

Figure 12:
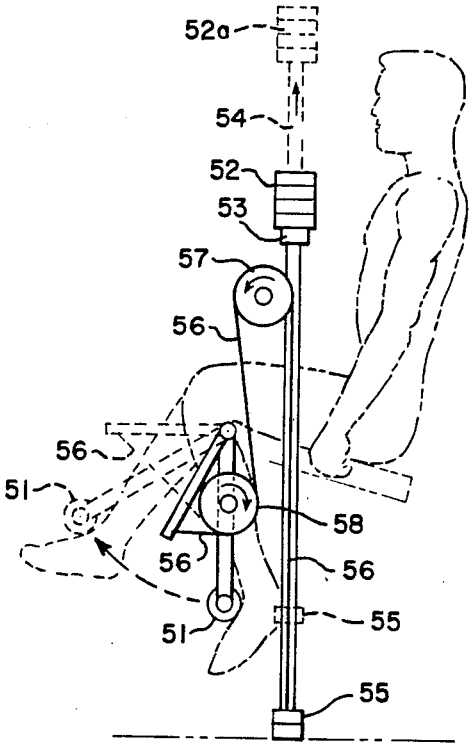

FIG. 12 shows similar mechanism in which the user's leg or legs are used to raise the roller against the force of the selected number of weights, thereby exercising different leg muscles. The only difference over the embodiment of FIG. 11 is that the belts are run under the second set of rollers 58 rather than over them (one set of V formation, the other of flat formation).

Figure 13:
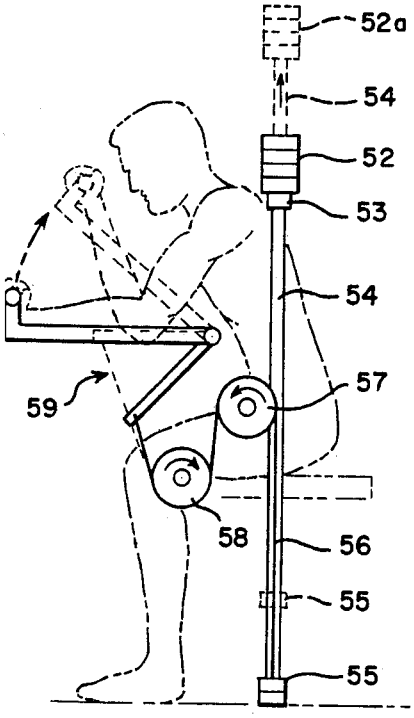

The embodiment of FIG. 13 is similar to that of FIG. 12 except for the relative positions of the upper and lower pulleys of the sets of pulleys 57 and 58 (one set V, the other flat) and for the provision of arm exercising input structure 59 to be grasped by the user and pushed upwardly away from the user's chest in arcuate motion, rather than directly outwardly in rectilinear motion as in the embodiment of FIGS. 1–10. This is known as the "bicep curl" exercise.

Figure 14:
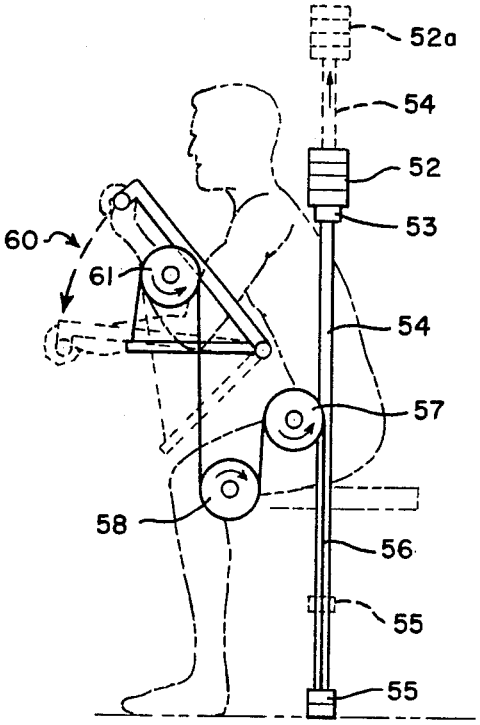

The embodiment of FIG. 14 is similar, except the motion of the input structure 60 is arcuately downward by reason of the provision of a third set of pulleys 61 (V or flat depending on the formation of the pulleys 58 of the second set). This is known as the "tricep press" exercise.

The embodiment of FIG. 15 is different from the foregoing in that the input structure 62 is attached to and guided by posts 63 by means of sliders 64 to which one set of ends of V-belts 65 are secured, their opposite ends being secured to elevator platform 66 after passing over pulleys 67. Otherwise, it is similar to the other embodiments. Lifting of selected weights 68 is by the user exerting downward force on input structure 62.

The embodiment of FIG. 16 is similar to the other embodiments except for input structures 69, which provides cranks 70 for rotative movement by the user pushing on pads 71. Arms 72 at the lower ends of vertical rods 73, respectively, execute partial rotary movement back and forth in response to muscular force applied by the user to pads 71. They raise elevator platform 74 through V-belts 75, 76, and 77 trained over respective sets of pulleys indicated generally by 78 and 79 interconnected by a crosspiece 80.

In each of the foregoing instances of the invention, the enumerated advantages are present, i.e. weight stacks at the level of the user's head and the capability of enclosing the operating mechanism by housings of visually pleasing, ornamental configurations. In each, there is no operating structure that rises above the weight stack in the normal rest position of each stack, and the housing is apertured, as at 11*a*, FIG. 2, to expose the stack of weights for viewing and, as at 11*b*, to permit upward passage therethrough of the selected weights to be lifted.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. Weight lifting apparatus for exercising the human body, comprising a stationary platform for receiving and supporting a stack of weights to be lifted; a framework providing a user accommodation location adjacent to said platform and supporting said platform at an elevated level, relative to a user sitting or standing at said user accommodation location and facing said stack, such that the position of the stack of weights will correspond approximately with the position of the user's head; weight carrier means including an elevator platform, and weight connection means rising substantially vertically from said elevator platform and extending in close association with said stationary platform and with the position of the stack of weights thereon so the user can conveniently select a desired number of weights from said stack for connection with said weight connection means; means operable by a user at said user accommodation location for attaching selected weights to said weight connection means; operating means arranged to be engaged by at least one body member of the user of the apparatus for muscle exercise; and force-transmitting means interconnecting said operating means with said carrier means.

2. Apparatus according to claim 1, wherein the force-transmitting means comprises pull lengths of flexible material and a system of pulleys over which said pull lengths are trained.

3. Apparatus according to claim 2, wherein the framework comprises a horizontal, bottom, base frame providing the user accommodation location; a substantially vertically extending box frame in which the stationary platform is supported; and a substantially horizontal top frame in which the operating means is mounted.

4. Apparatus according to claim 3, wherein both the stationary platform and the elevator platform are elongate; the weight connection means are spacedapart, vertical, slide rods rising from fixed attachment to said elevator platform and passing slideably through said stationary platform; there are a pair of the flexible pull lengths and a corresponding pair of pulley arrangements on which said flexible pull lengths are trained, respectively; and one set of ends of said flexible pull lengths are fixedly attached to said elevator platform and the opposite ends are fixedly attached to said operating means.

5. Apparatus according to claim 4, wherein the pull lengths of flexible material are V-belts; and the ends of said V-belts are each fixedly attached by insertion in a receiving bore having a knurled bore-defining surface and by cinch means pressing the inserted V-belt end tightly against said knurled surface.

6. Apparatus according to claim 4, wherein resilient bumper means are mounted on the upper surface of the elevator platform.

7. Apparatus according to claim 6, wherein the bumper means are coil springs encircling lower end portions of the slide rods, respectively.

8. Apparatus according to claim 7, wherein resilient bumper means are mounted on the upper surface of the stationary platform as a rest for a stack of weights.

9. Apparatus according to claim 1, including a stack of weights normally resting on the stationary platform.

10. Apparatus according to claim 9, wherein both the stationary platform and the elevator platform are elongate; the weight connection means are spacedapart, vertical, slide rods rising from fixed attachment to said elevator platform and passing slideably through said stationary platform and said stack of weights.

11. Apparatus according to claim 10, wherein the weight attachment means comprises the top weight of the stack being secured to the upper ends of the slide rods; and means for selectively attaching each of the lower weights of the stack to said slide rods.

12. Apparatus according to claim 11, wherein the means for selectively attaching each of the weights comprises registering bores in the said weights throughout the stack; a latch rod fitted into and extending through the registered bores of the stack and provided with a substantially vertical series of substantially horizontal, latch-bolt-receiving openings; latch-bolt-receiving passages extending substantially horizontally in said weights, respectively, and in registry with said latch-bolt-receiving openings of said latch rod for receiving part of a latch bolt inserted in said latch-bolt-receiving passage of a selected weight; and a latch bolt for manipulation by a user of the apparatus.

13. In weight lifting apparatus providing for a user accommodation location, a stationary platform adapted to receive a stack of individual weights; structure supporting the platform at an elevated level relative to said user-accommodation location such that the position of the stack will correspond approximately with the position of the user's head when the user is sitting or standing at said user accommodation location facing said stack; weight carrier means adapted to pick up a selected number of weights and extending substantially vertically in close association with said platform and with the position assumed by the stack of weights so as to receive a selected number of weights and so as to move them upwardly when force is applied to said carrier means; operating means arranged to be engaged by at least one body member of the user of the apparatus for muscle exercise; and force-transmitting means interconnecting said operating means with said carrier means.

14. Apparatus according to claim 13, wherein the force-transmitting means comprises pull lengths of flexible material and a system of pulleys over which said pull lengths are trained.

15. Apparatus according to claim 14, including a stack of weights normally resting on the platform and adapted to be picked up by the weight carrier means.

16. Apparatus according to claim 15, wherein the weight carrier means comprises vertical slide rod means; and wherein there are weight attachment means, which comprise the top weight of the stack being secure to the upper ends of the slide rods, and means for selectively attaching each of the lower weights of the stack to said slide rods.

17. Apparatus according to claim 11, wherein the top weight of the stack is above the framework.

18. Apparatus according to claim 17, additionally including a housing enclosing the framework, the stationary and elevating platform, the weight carrier means, and the stack of weights, said housing being apertured toward the user accommodation location to expose said stack of weights to the user's view and being apertured on top to provide for passage of at least a portion of the selected number of weights therethrough by reason of force exerted on the operating means by said user.

19. Apparatus according to claim 16, wherein the top weight of the stack is above the platform supporting structure.

20. Weight lifting apparatus for exercising the human body, comprising a structural framework having a substantially horizontally extending base frame providing a user accommodation location, a substantially vertical frame rising from securement to said base frame at one end of said user accommodation location, and a substantially horizontal upper frame extending from the upper end portion of said vertical frame in the opposite direction from said user accommodation location; a stationary platform for receiving and supporting a stack of weights, said platform extending substantially horizontally across and secured to said vertical frame at an elevated level relative to said base frame such that the head of a user sitting or standing on said base frame at said user accommodation location and facing said stack of weights will be approximately in line with said stack of weights, so a user can conveniently select a desired number of weights from said stack for any given exercise; weight carrier means, including an elevator platform and weight connection means rising substantially vertically from said elevator platform and extending in close association with said stationary platform and with the position of the stack of weights thereon; means operable by a user at said user accommodation location for attaching selected weights to said weight connection means; operating means arranged to be engaged by at least one body member of the user of the apparatus for muscle exercise; force-transmitting means interconnecting said operating means with said carrier means; and a housing enclosing said vertical frame and said horizontal upper frame and apertured above said stationary platform and toward said user accommodation location to expose said stack of weights to user view and apertured on top to provide upward passage for at least a portion of the selected number of weights to be lifted

* * * * *